US006722327B2

(12) United States Patent
Knecht et al.

(10) Patent No.: US 6,722,327 B2
(45) Date of Patent: Apr. 20, 2004

(54) DEVICE AND METHOD FOR CHANGING THE RELATIVE ROTATIONAL ANGLE OF A CAMSHAFT

(75) Inventors: Andreas Knecht, Kusterdingen (DE); Gerold Sluka, Nuertingen (DE); Ralf Naumann, Crimmitschau (DE)

(73) Assignee: Dr. Ing. h.c.F. Porsche AG, Stuttgart (DE)

( * ) Notice: Subject to any disclaimer, the term of this patent is extended or adjusted under 35 U.S.C. 154(b) by 0 days.

(21) Appl. No.: 10/197,477

(22) Filed: Jul. 18, 2002

(65) Prior Publication Data

US 2003/0015157 A1 Jan. 23, 2003

(30) Foreign Application Priority Data

Jul. 19, 2001 (DE) ..... 101 35 146

(51) Int. Cl.[7] ..... F01L 1/34

(52) U.S. Cl. ..... 123/90.17; 123/90.15; 123/90.27; 123/90.31; 251/12

(58) Field of Search ..... 123/90.15, 90.16, 123/90.17, 90.27, 90.31, 320, 321, 322, 347; 251/1, 12

(56) References Cited

U.S. PATENT DOCUMENTS 5,785,026 A * 7/1998 Moriya ..... 123/90.17
5,794,578 A 8/1998 Strauss et al.
5,941,203 A * 8/1999 Sato ..... 123/90.17
6,283,075 B1 * 9/2001 Schafer et al. ..... 123/90.17
6,631,700 B2 * 10/2003 Diggs et al. ..... 123/90.17

FOREIGN PATENT DOCUMENTS

| | | |
|---|---|---|
| DE | 19745908 | 4/1999 |
| DE | 19808618 | 9/1999 |
| DE | 19930711 | 8/2000 |
| DE | 10002512 | 7/2001 |

OTHER PUBLICATIONS

Specification, drawings, and Official Filing Receipt of patent application Ser. No. 09/765,398 filed on Jan. 22, 2001.

* cited by examiner

*Primary Examiner*—Thomas Denion
*Assistant Examiner*—Ching Chang
(74) *Attorney, Agent, or Firm*—Crowell & Moring LLP

(57) ABSTRACT

A device for an internal combustion engine includes a cell wheel and a blade wheel, which is mounted in the cell wheel so as to be relatively moveable and is actuated hydraulically by oil and via pressure chambers. The oil flows through axial lines into the pressure chambers, which are designed, on the one hand, between a shaft of an axial fastening screw, inserted from one face side of the camshaft, and a control sleeve, which envelops the shaft and rests in at least one receiving borehole, and is designed, on the other hand, between the control sleeve and a borehole, which is arranged coaxially to the latter and belongs to a hub. For an optimal design of the lines by the control sleeve and a simple assembly of the control sleeve, the control sleeve and the fastening screw, exhibiting the shaft, are inserted starting from the same face side, which control sleeve rests in corresponding receiving boreholes of the hub.

12 Claims, 4 Drawing Sheets

DEVICE AND METHOD FOR CHANGING THE RELATIVE ROTATIONAL ANGLE OF A CAMSHAFT

This application claims the priority of German Patent Document 101 35 146.1, filed Jul. 19, 2001, the disclosure of which is expressly incorporated by reference herein.

BACKGROUND AND SUMMARY OF THE INVENTION

The present invention relates to a device for changing the relative rotational angle of an internal combustion engine.

There exists a device of the aforementioned class, German Patent Document DE 199 30 711 C1, where the pressure chambers between a cell wheel and a blade wheel are actuated starting from axial lines, designed as boreholes or ring channels. The boreholes are provided in hub segments of the device and the camshaft. The ring channels envelop a shaft of a fastening screw, serving to hold the device on the camshaft.

German Patent Document DE 100 02 512, for which U.S. patent application Ser. No. 09/765,398 is a counterpart U.S. application, shows lines, which are connected to pressure chambers of a comparable device and which are formed by means of axial ring channels. The ring channels are formed, on the one hand, by means of an outside of a control sleeve and a borehole in the hub segments of the device and the camshaft and, on the other hand, by means of an inside of this control sleeve and a shaft of an axial fastening screw, which connects the device to the camshaft. The control sleeve is moved into its construction position starting from a side, facing away from a screw head of the fastening screw, and rests in boreholes of the hub segments.

The object of the present invention is to form the lines, which are connected to the pressure chambers and belong to the device, by means of the control sleeve and to optimize the assembly of the control sleeve.

The advantages, targeted primarily with the invention, lie in that the control sleeve and the fastening screw can be installed from one and the same side, a feature that simplifies the assembly itself and support the reliability of the assembly. At the same time the centering mechanisms, which are formed by the radial support legs, are quite suitable for the targeted application and can also be realized easily. The support legs can be attached either directly to the shaft or to the control sleeve. However, it is also conceivable to combine them structurally with an insert sleeve or a jacket sleeve and to make them of plastic. Finally it is possible to prefabricate the control sleeve and the fastening screw as a preassembled module, which is then moved into the defined construction position when the device is connected to the camshaft.

The drawings depict one embodiment of the invention, which is described in detail below.

Other objects, advantages and novel features of the present invention will become apparent from the following detailed description of the invention when considered in conjunction with the accompanying drawings.

DETAILED DESCRIPTION OF THE DRAWINGS

Figure 1:
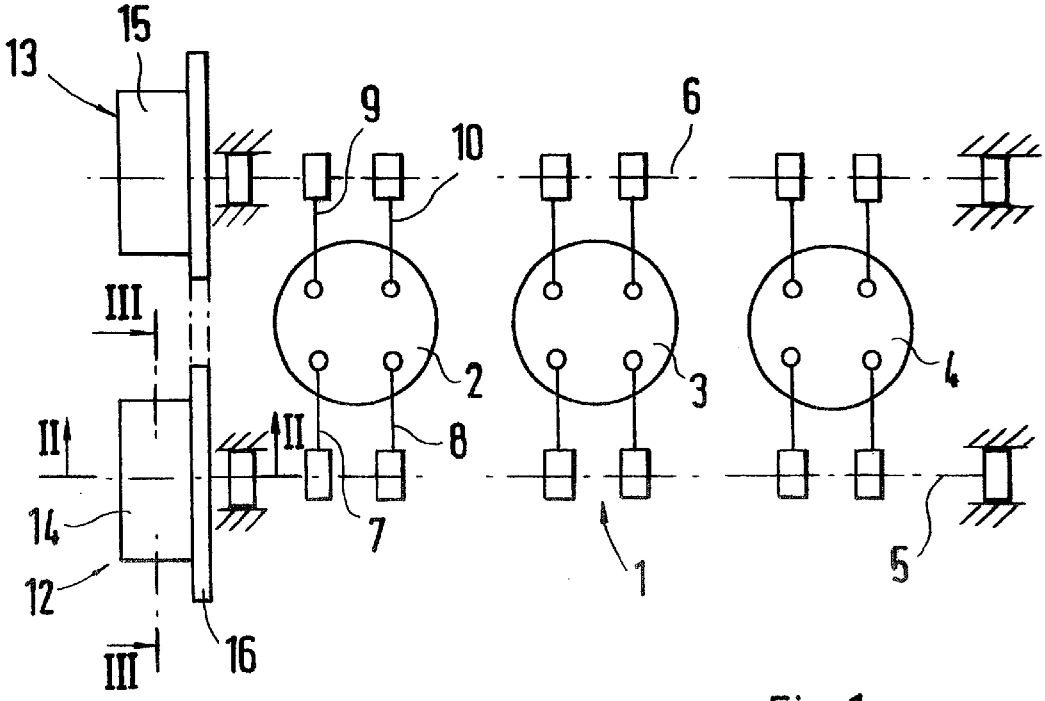
FIG. 1 is a schematic view of an internal combustion engine with a device according to the present invention.

An internal combustion engine 1 of the Otto engine design comprises several cylinders 2, 3, 4 and camshafts 5, 6. Each cylinder, for example, cylinder 2, includes two inlet valves 7, 8 and two outlet valves 9, 10, all as illustrated in FIG. 1. The inlet valves 7, 8 and the outlet valves 9, 10 are housed in the shape of a V in a cylinder head (not illustrated) of the internal combustion engine. Both camshafts 5, 6 are connected together by means of a continuous drive, for example belts or chain, looped around corresponding drive wheels. The continuous drive is coupled to a crankshaft (not illustrated) and is effective adjacent to face sides 12, 13 of the camshafts 5, 6. There are devices 14, 15 that are attached coaxially to the face sides 12, 13, for the purpose of hydraulic adjustment of the relative position of rotation of these camshafts. Each device, which is constructed, for example, like a vane-cell-pump, has an impact on the control periods of the valves 7, 8, in order to optimize the operation of the internal combustion engine, among other things, with respect to the exhaust emission.

Figure 3:
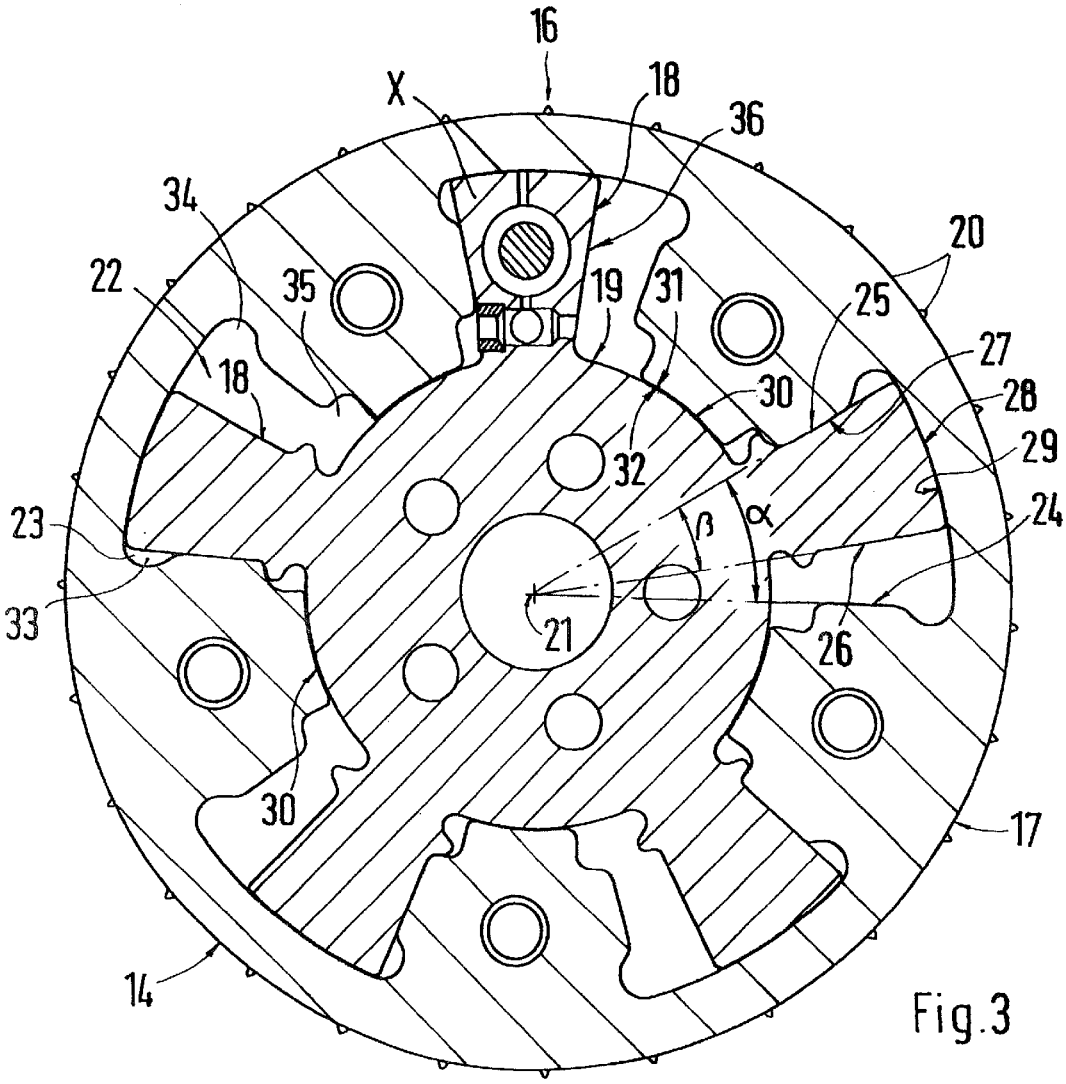
FIG. 3 is a sectional view along the line III—III of FIG. 1.

The device 14, which structurally is equivalent to the device 15, exhibits a circular cylindrical configuration, and exhibits a drive wheel 16, designed as a chain wheel, for the camshaft 5, a cell wheel 17 and a blade wheel 19, provided with radial blades 18, as can be seen in FIG. 3. The drive wheel 16, the cell wheel 17 and the blade wheel 19 are arranged coaxially to the camshaft 5, with the drive wheel 16 and the cell wheel 17 forming a module 20 that is connected together. In contrast, the blade wheel 19, which can be rotated about an axis of rotation 21, is housed through the intermediary of the blades 18 in pressure chambers 22, 23 of the cell wheel 17 so as to be relatively moveable. Each pressure chamber 22, 23, of which five such pressure chambers are provided per device 14, is equipped with a first stop face 24 and a second stop face 25 for corresponding first and second stop faces 26, 27 of the blade 18. All stop faces 24, 25 and 26, 27 run radially to the axis of rotation 21. Yet the angle alpha, which the stop faces 24, 25 enclose, is larger than the angle beta of the stop faces 26, 27 of the blade 18.

Figure 2:
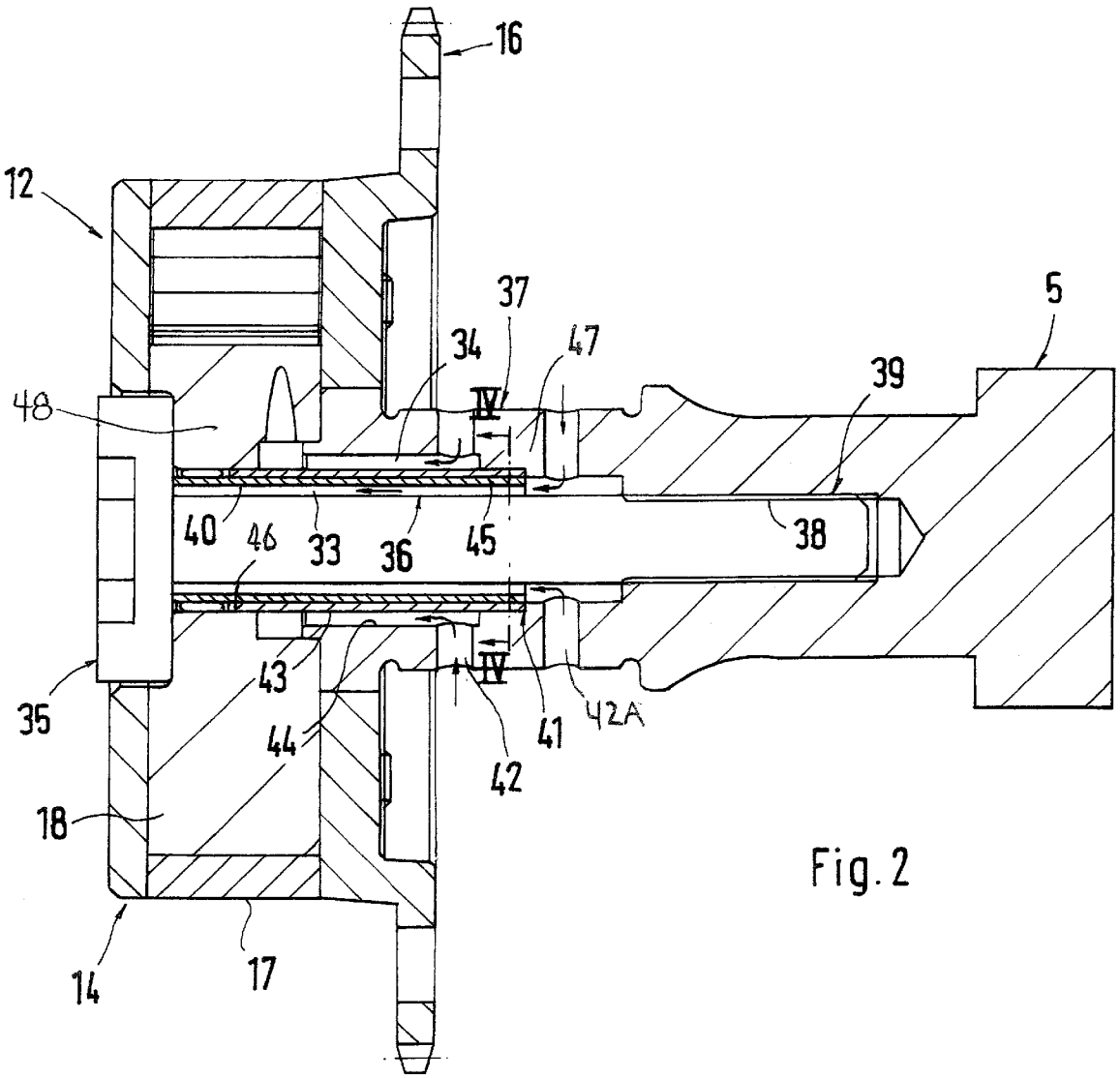
FIG. 2 is a sectional view along the line II—II of FIG. 1 on an enlarged scale.

Moreover, the pressure chambers 22, 23 are also defined by a circular area 28, up to which a circular area 29 of the blade 18 is moved. Both circular areas 28, 29 are effective as sealing surfaces. At location 30 there are circular areas 31, 32, forming comparable sealing surfaces, between the blade wheel 19 and the cell wheel 17. The pressure chambers 22, 23, serving the adjustment of the blade wheel 19, are attached to axial lines 33, 34, as can be seen in FIG. 2, which are designed for feeding oil and are arranged adjacent to a fastening screw 35. The device 14 is held on the camshaft 5 with the fastening screw 35. In this respect the fastening screw 35 penetrates with a shaft 36 a hub 37 and is screwed with a threaded bolt 38 into a taphole 39 of the camshaft 5. To guarantee the reciprocal actuation of the pressure chambers 22, 23, the lines 33, 34 are separated from each other. In this respect the annular line 33, attached to a radial feed line 42A, is designed between the shaft 36 and an inside 40 of a control sleeve 41, which envelops the shaft 36 and is arranged coaxially to the latter. The line 34 exhibits an annular cross section, is attached to a radial feed line 42 and is defined by an outside 43 of the control sleeve 41 and a line borehole 44 of the hub 37. Starting from the same face side 12, the control sleeve 41 is inserted, like the fastening screw 35, into receiving boreholes 45, 46 of the hub 37, exhibiting hub segments 47, 48. To this end, the control sleeve 41 is fixed in position on the shaft 36 of the fastening screw 35 by means of centering mechanisms 49, where the centering mechanisms 49 are formed by radial support elements 50, which extend in the form of a star between the inside 39 of the sleeve and the shaft 36.

Figure 4:
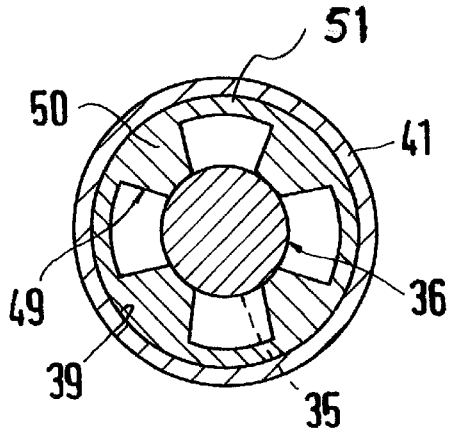
FIG. 4 is a sectional view along the line IV—IV of FIG. 2 on an enlarged scale with a first embodiment.
Figure 5:
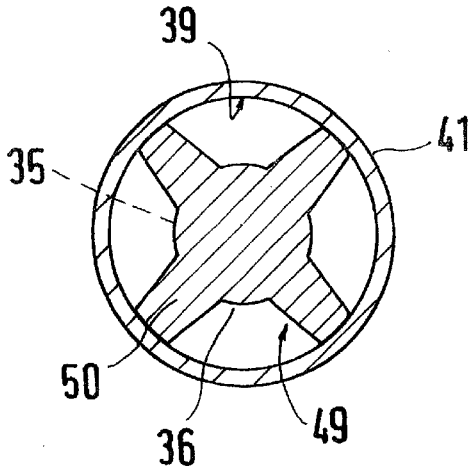
FIG. 5 is a view, according to FIG. 4, with a second embodiment.
Figure 6:
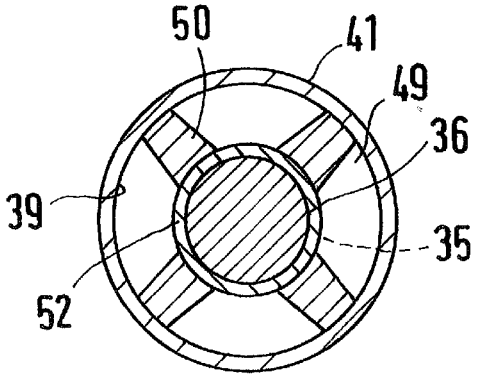
FIG. 6 is a view, according to FIG. 4, with a third embodiment.

According to a first embodiment, the support elements 50 are connected either directly to the control sleeve 41 or to the insert sleeve 51, as can be seen in FIG. 4, which is inserted into the control sleeve 41 with a corresponding fit. In contrast, the radial support elements 50 are attached, according to a second embodiment, as can be seen in FIG. 5, directly to the shaft 36 of the fastening screw 35. Moreover, a third embodiment, as can be seen in FIG. 6, exhibits support elements 50, which are connected to a jacket sleeve 52, disposed on the shaft 36. To simplify the manufacture, the support elements 50 and the insert sleeve 51 or the jacket sleeve 52 are made as one piece and of suitable plastic.

The control sleeve 41 can be installed, independently of the fastening screw 35, into the receiving boreholes 45, 46 of the hub segments 47, 48 of the device 14 and the camshaft 5 or together with the fastening screw. In the latter case it is conceivable that the control sleeve 41 and the fastening screw 35 are combined as a preassembled module.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A device for changing a relative rotational angle of a camshaft of an internal combustion engine, comprising a cell wheel and a blade wheel, the blade wheel mounted in the cell wheel so as to be relatively moveable and actuated hydraulically by means of oil and via pressure chambers, wherein the oil flows through axial lines into the pressure chambers, which are designed, on the one hand, between a shaft of an axial fastening screw, inserted from one face side of the camshaft, and a control sleeve, which envelops the shaft and rests in at least one borehole, and is designed, on the other hand, between the control sleeve and a hub, arranged coaxially to the latter, wherein the control sleeve and the fastening screw, exhibiting the shaft, are inserted starting from a same face side of the camshaft, which control sleeve rests in corresponding receiving boreholes of the hub.

2. The device, as claimed in claim 1, wherein the control sleeve interacts with the shaft of the fastening screw by means of centering mechanisms.

3. The device, as claimed in claim 2, wherein the centering mechanisms are formed by means of radial support elements which extend between the shaft and the control sleeve.

4. The device, as claimed in claim 3, wherein the support elements are provided on the control sleeve.

5. The device, as claimed in claim 3, wherein the support elements are provided on an insert sleeve inserted into the control sleeve.

6. The device, as claimed in claim 3, wherein the support elements are disposed on a jacket sleeve disposed on the shaft.

7. The device, as claimed in claim 5, wherein the support elements and the insert sleeve are made as one piece and/or are made of plastic.

8. The device, as claimed in claim 6, wherein the support elements and the jacket sleeve are made as one piece and/or are made of plastic.

9. The device, as claimed in claim 3, wherein the support elements of the centering mechanisms are mounted on the shaft of the fastening screw.

10. The device, as claimed in claim 1, wherein the fastening screw and the control sleeve are assembled together.

11. The device, as claimed in claim 1, wherein the control sleeve and the fastening screw are assembled separately from each other.

12. The device, as claimed in claim 1, wherein the receiving boreholes of the hub are provided in both hub segments of the camshaft and in the device.

* * * * *